US006721430B2

(12) United States Patent
Wang

(10) Patent No.: US 6,721,430 B2
(45) Date of Patent: Apr. 13, 2004

(54) MUSICAL BENCH

(75) Inventor: Leo Wang, Arcadia, CA (US)

(73) Assignee: Dragon Claw (U.S.A.) Incorporated, Irwindale, CA (US)

( * ) Notice: Subject to any disclaimer, the term of this patent is extended or adjusted under 35 U.S.C. 154(b) by 103 days.

(21) Appl. No.: 09/802,589

(22) Filed: Mar. 8, 2001

(65) Prior Publication Data

US 2002/0126863 A1 Sep. 12, 2002

(51) Int. Cl.[7] ..... H04R 25/00

(52) U.S. Cl. ..... 381/334; 381/301; 381/333; 381/335

(58) Field of Search ..... 84/402, 403, 410; 297/186, 217.4; 441/130; 381/300, 301, 332, 333, 334, 335, 388, 396

(56) References Cited

U.S. PATENT DOCUMENTS 4,725,253 A * 2/1988 Politte ..... 441/130
5,224,891 A * 7/1993 Stephens ..... 441/130
5,387,178 A * 2/1995 Moses ..... 600/27
6,075,868 A * 6/2000 Goldfarb et al. ..... 381/301
6,135,551 A * 10/2000 Linder ..... 297/217.4
6,376,757 B1 * 4/2002 Clausen ..... 84/402

* cited by examiner

*Primary Examiner*—Suhan Ni
(74) *Attorney, Agent, or Firm*—Thomas I. Rozsa; Tony D. Chen

(57) ABSTRACT

A method and apparatus is disclosed where a musical system is integrated with an outdoor seating apparatus, such that a user may rest comfortably while listening to music. The musical system is designed to withstand outdoor weather conditions. The musical system, typically a radio, is integrated with the backrest portion of the seating apparatus. The radio is designed to function in both extreme hot and cold temperatures. The radio also features RCA inputs, so that external signal inputs may be played on the radio's speakers. A cellular modem and interface is present so that a computer can connect to the Internet. An adapter is also present so a cell phone can connect to the radio, and use the radio's speakers. The speakers can be magnetic coil based, or may use flat panel speaker technology.

7 Claims, 6 Drawing Sheets

MUSICAL BENCH

BACKGROUND OF THE INVENTION

1. Technical Field

The invention relates to a musical bench. More particularly, the invention relates to an apparatus and to a family of methods implementing a bench that plays music.

2. Description of the Prior Art

Presently in the world there exists a divide where tools for enjoyment, and tools for comfort, are not integrated. Tools for entertainment include radios, CD players and computers. Tools for comfort include chairs, sofas and benches However, there have been some attempts to bridge the two together. Linder, Inflatable chair with speakers, U.S. Pat. No. 6,135,551, Oct. 24, 2000, discloses an inflatable chair with speakers that are mounted flush within the inflatable chair. Similarly, Pollock, Communication system that supports wireless remote programming process, U.S. Pat. No. 5,490, 711, Jan. 19, 1999, discloses a rocking chair that contains a concertina musical instrument.

The problem with the aforementioned inventions is that they are not well suited for functioning outdoors. They can easily fail in extreme hot, cold or humid situations. Also, because they are designed to function indoors, they fail to have other integrated items that would be of great value in an outdoor setting.

What is needed is a device that can perform many of the amenities found indoors in an outdoor setting.

SUMMARY OF THE INVENTION

A method and apparatus is disclosed where a musical unit is integrated with an outdoor seating apparatus, such that a user may rest comfortably while listening to music. The musical unit is designed to withstand outdoor weather conditions. The musical unit is integrated with the backrest portion of the seating apparatus. The unit typically has two parts; the first part is an enclosure that a radio shares with a speaker, and a second part where another speaker has its own enclosure.

The unit is designed to function in both extreme hot and cold temperatures. The unit also features RCA inputs, so that external signal inputs may be played on the unit's speakers. A cellular modem, and interface is present, so that a computer can connect to the unit and use the Internet. Also, an adapter is present so that a cell phone can use the unit's speakers. The unit is also adapted to perform intercom features, such as two-way communication with another intercom site.

The speakers can be based on magnetic coil or flat panel speaker technology. The flat panel speakers may use the seating frame to project sounds. The flat panel emitters can be adapted to take into account the material and geometry of the seating apparatus.

DESCRIPTION OF THE PREFERRED EMBODIMENT

Figure 1:
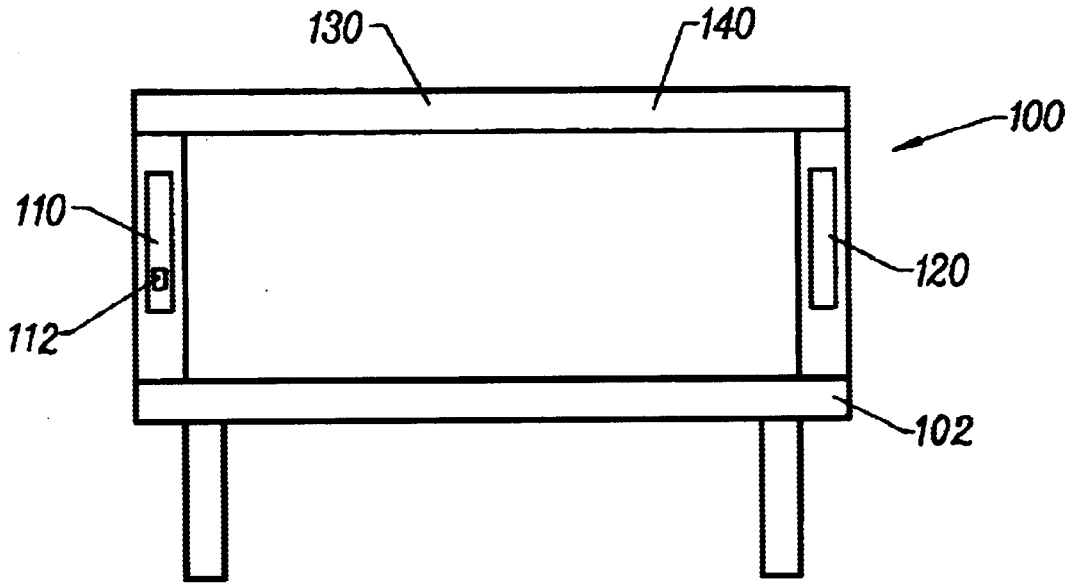
FIG. 1 is a diagram illustrating the frontal view of the musical bench, with the speakers orientated vertically, according to the present invention.

FIG. 1 is a frontal view of the musical bench 100. The bench has a seating area as is customary in conventional benches, the front view of the seating area shown at 102. The bench 100 also has an enclosed radio component attached to one backing 110. Two speakers are present. The first backing 110 includes a radio player 112 and one speaker occupies the same enclosure as the radio player in backing 110 while. The other speaker occupies a separate enclosure and is housed within opposite backing 120. The speakers may face forward, or may face inward. Each enclosure is attached to the bench, either by a highly non-degradable adhesive, or by metal screws. An amplifier is also present, and may be located in either enclosure, but is typically located in the same enclosure as the radio. Three wire leads extend from the amplifier; one lead is the input signal from the radio, while the other two leads each extend to a speaker. The amplifier lead that extends from the enclosure where the amplifier is located, to the other enclosure, passes one of the backing panels 130, of the bench to the other speaker.

In another embodiment, one enclosure contains an amplifier and speaker, while the other enclosure contains a speaker. The amplifier receives a signal input through an adapter from an external source, such as, a CD player or cell phone.

Figure 2:
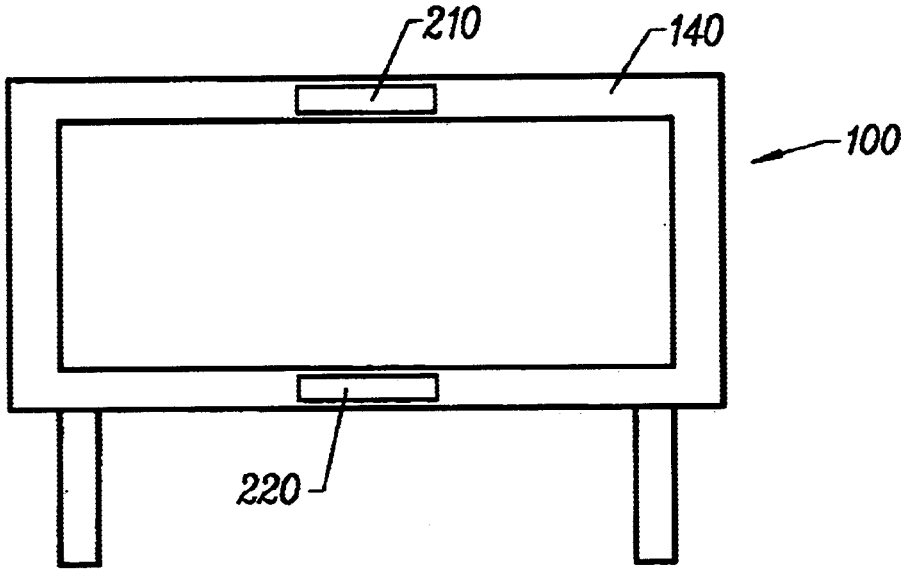
FIG. 2 is a diagram illustrating the frontal view of the musical bench with the speakers orientated horizontally, according to the present invention.

In another embodiment, the enclosures 210, 220 are mounted top to bottom as shown in FIG. 2.

The radio consists of a single chip FM, AM or both, tuner chip such as the OM5 6 1 0 from Phillips. The tuner is mounted on a printed wire circuit board (PCB) with controls interfaced to the case of an electronics module, for example the 1000 model produced by DCA of Cushing, Okla. This is accomplished by building a wiring harness with switches that mate directly to the molded housing. An alternate method is to connect the harness to the membrane control panel that integrates the basic functions.

The typical operating environment for the musical bench is outdoors, for example, as patio or lawn furniture. The musical bench is designed to operate in all seasons. One design goal is to ensure that the radio can operate in a temperature range from 0 to 70'C. The radio, amplifier and speaker unit (UNIT) can fail in several ways, two of which are, electrical circuitry failure or speaker failure.

The power source consists of a battery source providing an input voltage from 2.7–9.0 volts. A voltage from 2.7–9 volts is ideal to prevent overheating of the circuitry at extremely high temperatures (discussed infra). The batteries can be three lithium batteries.

In another embodiment, NiCad batteries are used. The NiCad batteries are continually recharged by solar panels attached to the top of the backrest of the bench 140. The solar panels are attached to the NiCad batteries through copper wires. The copper wires pass from the solar panels, through holes within the backrest, through holes in the back of the enclosure, to the location of the batteries within the enclosure. Typically, the batteries are located in the upper portion of the enclosure. An automatic switch prevents charging of the batteries when they have reached a full charge. A Zener diode is present to prevent a reverse current from damaging the solar panels.

Electrical failure occurs when the circuitry overheats causing melting; or if the circuitry drops to too low a temperature, then the circuitry can become brittle and crack. There are two main forms of heat transfer, conduction and convection. The enclosure is formed out of plastic, typically ABS plastic or fiberglass. Plastic has a low conductance, thus heat or cold from the metal portions of the bench will have a low conductance to the radio circuitry inside the enclosure. The enclosure is also designed to be air and watertight. Keeping moving air out; reduces hot or cold convective elements from affecting the radio circuitry. The air tightness also prevents moisture from entering the enclosure. Moisture causes shorts, in addition to front damage. The circuitry can also be vacuum-sealed in an impermeable plastic wrap.

Figure 3:
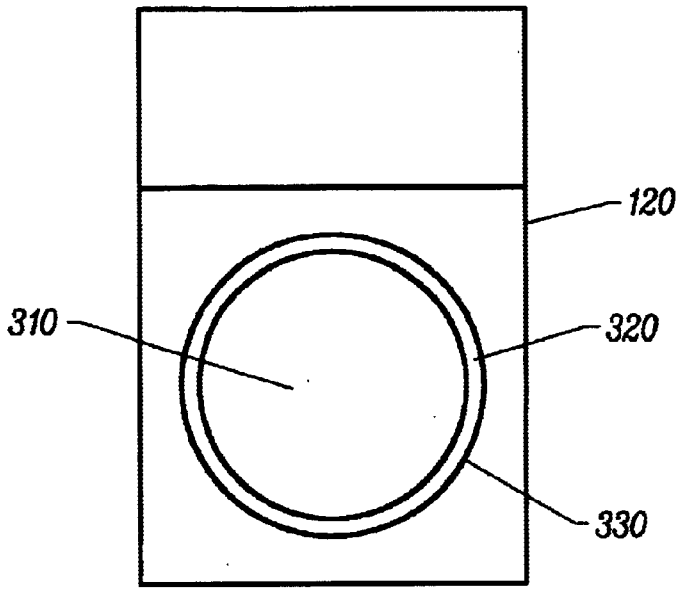
FIG. 3 is a diagram illustrating the frontal view of the enclosure with a speaker grill, according to the present invention.

The speaker is constructed to resist cracking, and for superior sound quality. Polypropylene is a type of plastic that provides good acoustical performance while also having good weather resistance. Also, a weather resistant epoxy resin such as EPOXY SYSTEMS product #401 urethane coating can be used to adhere the polypropylene to the frame. The speaker is mounted within the enclosure by screws or is adhesively attached by a weather resistant epoxy. The speaker 310 is typically located on the lower portion of the enclosure as shown in FIG. 3.

In another embodiment, the speaker has an attachable front grill 320. The front grill is designed to fit shapely with the frontal area of the enclosure. The front grill also contains a contoured portion on the backside of the grill where the front portion of the speaker 310 may rest upon. The contoured portion prevents movement of the speaker in the vertical and horizontal direction. The perimeter 330 of the front grill is lined with rubber so that a watertight seal is formed. The contoured portion of the grill that holds the speaker also has a rubber watertight seal.

Figure 4:
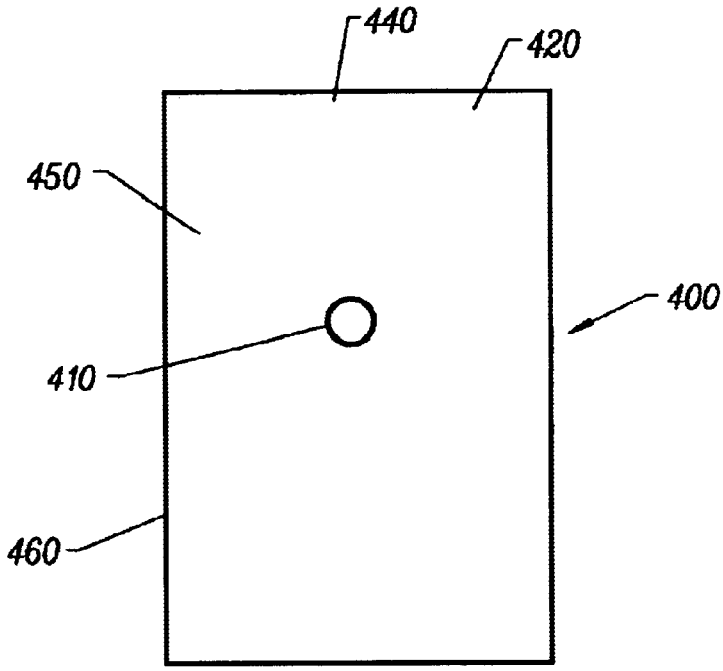
FIG. 4 is a diagram illustrating a front cover and emitter for the enclosure, according to the present invention.

FIG. 4 illustrates another embodiment, where flat panel speakers 420 are used. Unlike conventional speakers which use a magnet to vibrate a membrane as a whole, flat panel speakers use an electronic "exciter" 410 on the back of a speaker material. The exciter sends electronic "taps" along the surface of the speaker material. By changing and regulating each electronic tap, the exciter creates different volumes and frequencies that vibrate through the panel. The resulting vibrations are heard as sound.

The flat panel speakers are integrated with the front cover 400 of the enclosure. The outer perimeter 440 of the front cover is composed of plastic, while the inner area 450 is a weather resistant material such as plastic or polypropylene. A side 460 of the cover is hingedly affixed to a side of the enclosure. An exciter 410 is attached to the center of the cover. In operation, the exciter receives a signal and reproduces the signal by tapping the inner area of the cover.

Figure 5:
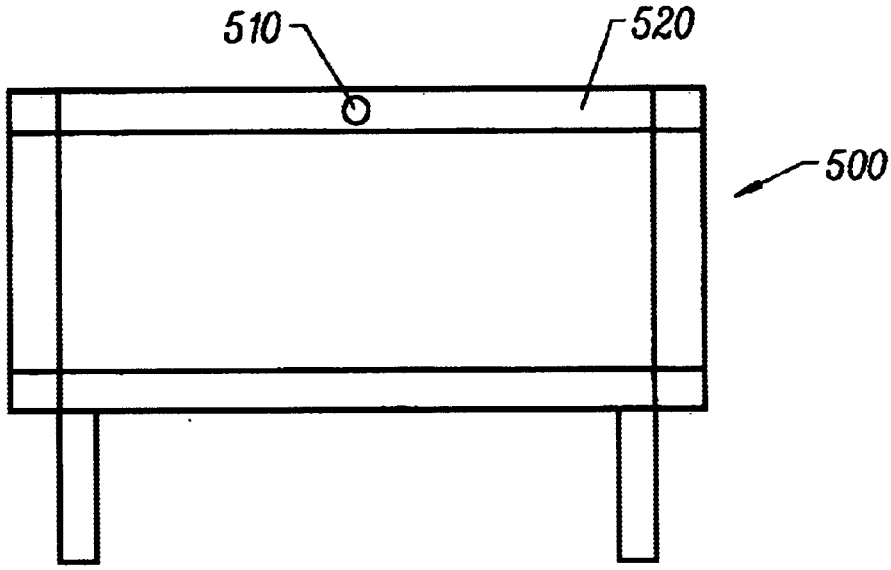
FIG. 5 is a diagram illustrating an emitter placed on a musical bench, according to the present invention.

FIG. 5 illustrates another embodiment, where the exciter 510 is attached to the backrest portion 520 of the bench 500. The backrest 520 is typically constructed of iron, steel, aluminum, or wood. The exciter 510 taps along the surface of the backrest 520 to produce sound. Multiple exciters may be used to improve sound quality. When multiple exciters are used with wood, the differences in material density should be mapped to ensure proper placement. Since different densities produce different sounds or tonal qualities, each exciter should be placed to account for the changes. With proper placement of the exciters, an accurate reproduction of the input signal will be achieved.

Figure 6:
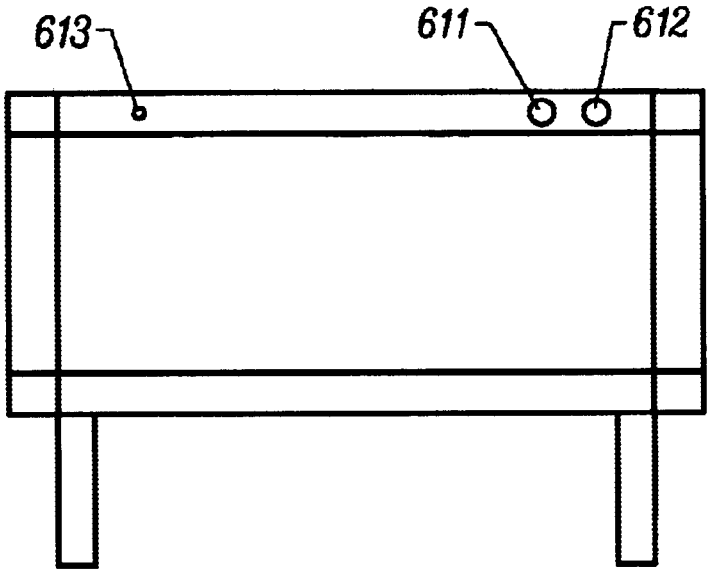
FIG. 6 is a diagram illustrating multiple emitters applied to a musical bench, according to the present invention.

For example, in FIG. 6, the bench backrest is constructed of wood. The right portion of the upper bar has a higher density, lower resonance than the left portion. To compensate, two exciters 611, 612 are place on the right side while only one exciter 613, is placed on the left. The result is balanced stereo sound.

Figure 7A:
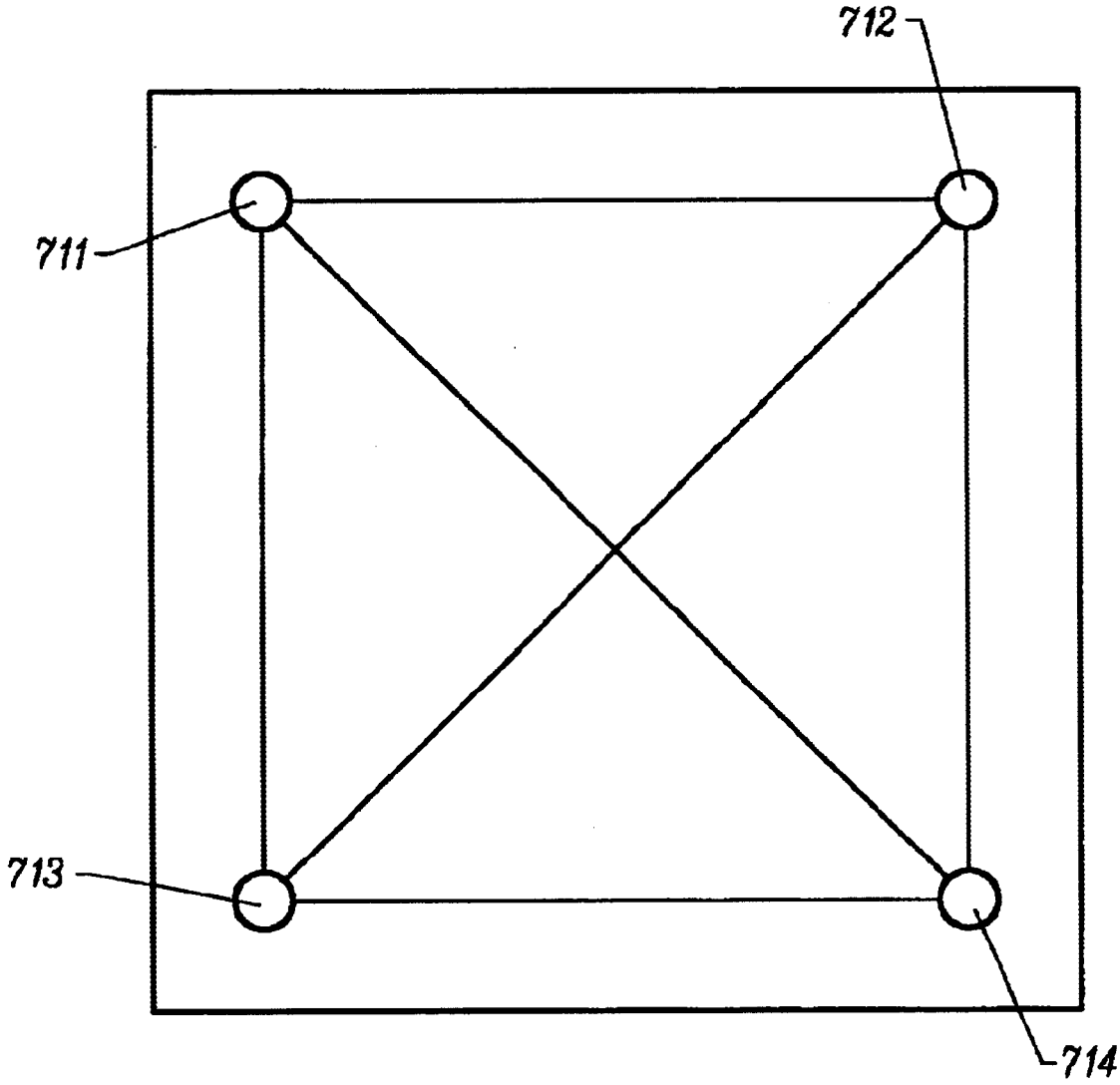
FIGS. 7A, 7B and 7C are diagrams illustrating the use of multiple emitters, according to the present invention.

Alternatively, the multiple exciters 711, 712, 713, 714 can be placed in uniform positions, such as the shape of a square as shown in FIG. 7A. To achieve an accurate signal reproduction, each exciter is calibrated to compensate for the variations in density.

Figure 7B:
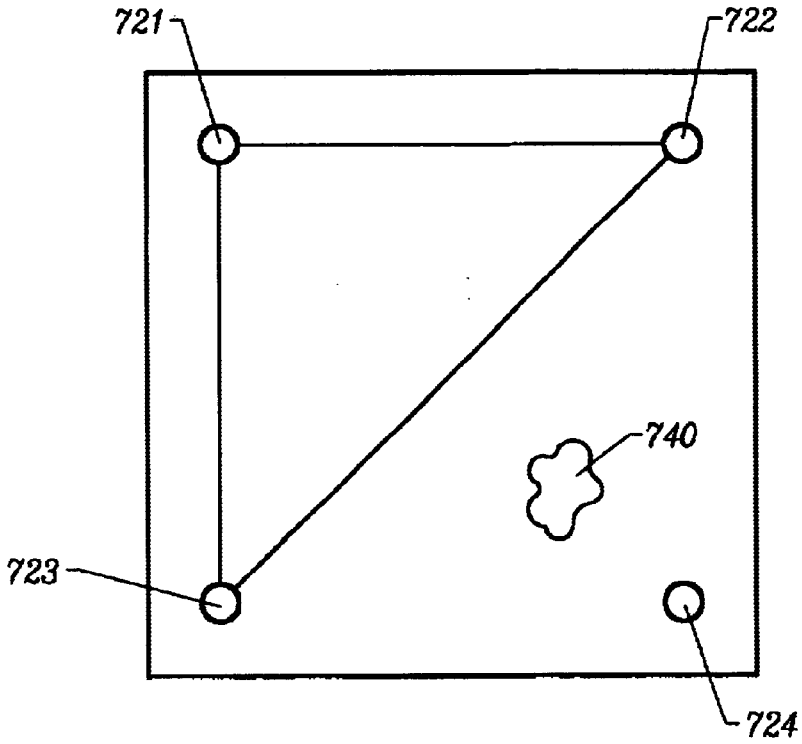

For example, in FIG. 7B, a wooden knot 740, lies close to an emitter 724. The wooden knot is higher in density than the rest of the backrest, and the higher density causes a lower resonance response for low frequency is vibrations. The wooden knot does not effect higher frequency vibrations. Thus, lower frequency sounds, such as bass, will be difficult to produce at the knot's location.

The high frequency signals of the four exciters are calibrated to interact with each other based upon the shape of the square that they form. This produces a uniform sound for high frequencies. However, the low frequency signals are calibrated to be produced mainly by three exciters 721, 722, 723, which are not in close proximity to the high-density wood knot 740. This produces a uniform sound for lower frequencies.

Figure 7C:
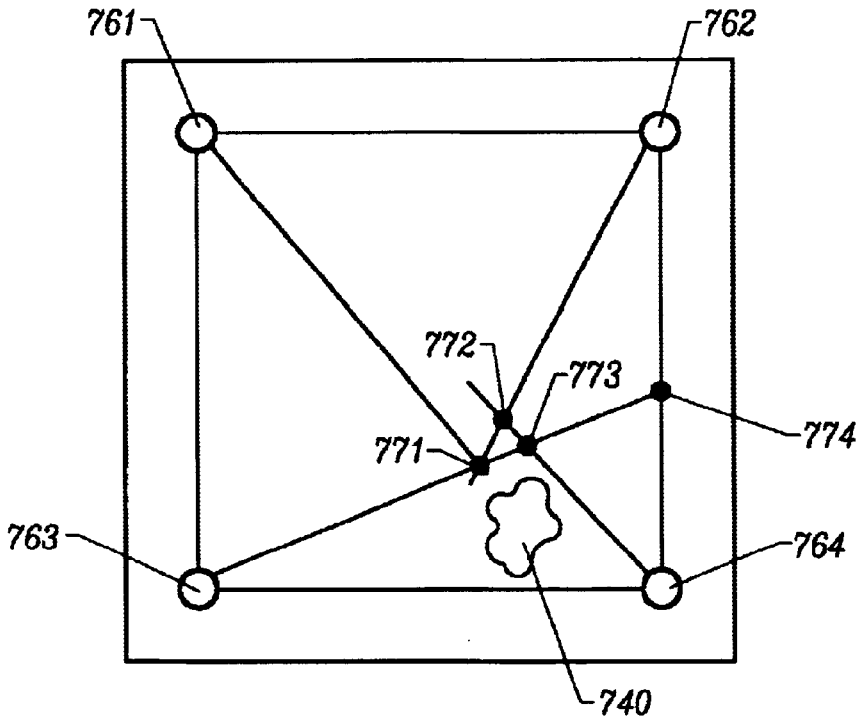

FIG. 7C, illustrates another embodiment, where the exciters are calibrated to produce concentrated volume nodes around the wooden knot 740. Concentrated volume nodes can be produced where peak values of intersecting sound waves 771, 772, 773, 774 meet. The emitters 761, 762, 763, 764 are designed to produce signals such that their sound waves will have intersecting peak values at predetermined locations. The distribution of several volume nodes around the wooden knot 740 will compensate for the low resonance area, and produce an even sound reproduction.

In another embodiment, the musical bench contains an integrated sensor chip that is integrated with the UNIT. The sensor chip is used to detect when someone is sitting on the bench. Attached to the sensor chip is a sensor device.

Figure 8:
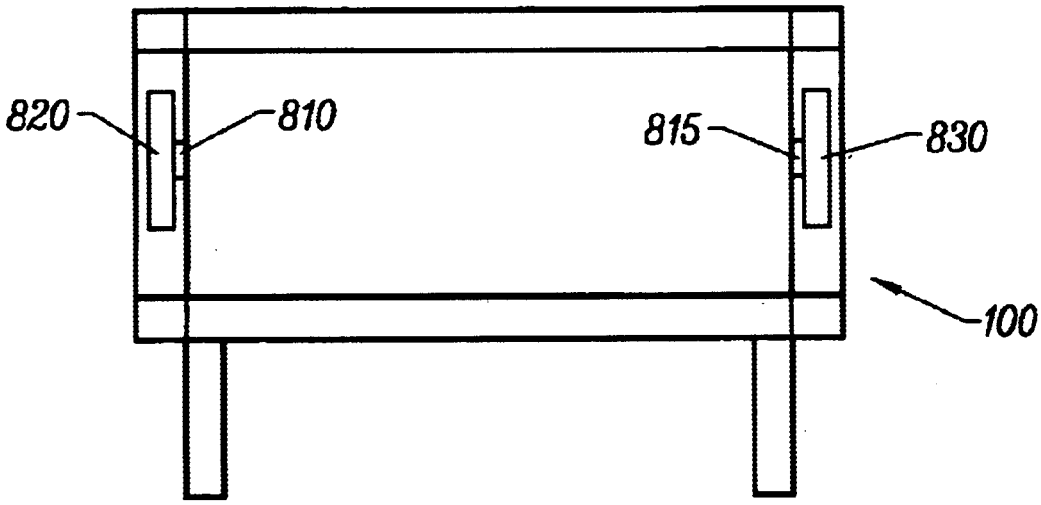
FIG. 8 is a diagram illustrating the placement of an infrared sensor, according to the present invention.

One type of sensor device is an infrared sensor. The infrared sensor has an infrared emitter and receiver. FIG. 8 illustrates how the emitter 810 and receiver 815 are placed on the side of each enclosure 820, 830, facing each other. The emitter 810 emits an infrared beam so the receiver 815 can receive the beam. When a user sits on the bench 100, he causes the beam stream to break. When the receiver no longer receives the beam, it causes a trigger in the sensor ship. This trigger turns on the radio.

In another embodiment, the UNIT has a receiver for receiving a microchip containing prerecorded sounds. The prerecorded sounds can consist of music, but a typical application would be a recorded nursery rhyme. When integrated with the sensor embodiment, a child can merely sit on the bench and hear a prerecorded nursery rhyme. The UNIT also contains a memory that can bookmark a position on the nursery rhyme. If the play of a nursery rhyme ends before it is finished, the memory will save the position and will start from that saved position when activated again.

In another embodiment, the UNIT has microphone and RCA inputs so that an external signal can be input from an external source such as a tape recorder or CD player. An auxiliary switch on the UNIT is used to switch to an auxiliary mode. In auxiliary mode, the external input signal is amplified and played through the UNIT's amplifier and speakers. There is also an adapter so that a signal from a cell phone can be played on the UNIT's speakers.

In another embodiment, a radio transmitter/receiver (TR) is integrated with the UNIT. The UNIT can receive external data flow from a Personal Digital Assistant (PDA) or from a computer through a connector means such as a serial, parallel, or T-based connector. The TR is compliant with mobile phone protocols, thus a user can connect a computer to the TR and connect to the Internet through a dial-up process.

In another embodiment the UNIT acts as a wireless intercom. The TR can be configured to communicate with a local intercom system. The intercom system is enabled to receive radio signals produced by the TR, and the intercom system also sends radio signals that are received by the TR. Both the UNIT and intercom system, are set to receive when they are not transmitting. The UNIT is set to transmit either by the depression of an on button, or may have a voice activated on switch.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

What is claimed is:

1. An apparatus comprising:

a. a bench suitable for use both indoors and outdoors;

b. a bench including an elongated backrest having a first side and a second side;

c. a first enclosure housing a radio player and a speaker designed to function in both hot and cold temperatures, the first enclosure attached to said first side of said backrest;

d. a second enclosure housing a speaker designed to function in both hot and cold temperatures, the second enclosure attached to said second side of said backrest; and e. said radio player connected in a way so that when said radio player is turned on, audible sound is emitted from both speakers.

2. The apparatus in accordance with claim 1, wherein said first enclosure and said second enclosure are designed to be air and water tight.

3. The apparatus in accordance with claim 1, wherein said first enclosure and said second enclosure are each made out of plastic.

4. The apparatus in accordance with claim 1, wherein each of said enclosures further respectively comprises a cover.

5. The apparatus in accordance with claim 3, wherein each of said covers is weatherproofed by attached strips of rubber along a perimeter of said cover and along the perimeter of an open end of the respective enclosure to which the cover is attached.

6. The apparatus in accordance with claim 1, wherein said radio is encapsulated in the substantially water and air impermeable wrapping.

7. The apparatus in accordance with claim 1, wherein said speaker is magnetic coil based.

* * * * *